US005343281A

United States Patent [19]

Yamada

[11] Patent Number: 5,343,281

[45] Date of Patent: Aug. 30, 1994

[54] AUTOMATIC DOCUMENT CONVEYANCE DEVICE

[75] Inventor: Yasuhi Yamada, Hachioji, Japan

[73] Assignee: Konica Corporation, Tokyo, Japan

[21] Appl. No.: 980,905

[22] Filed: Nov. 24, 1992

[30] Foreign Application Priority Data

Dec. 13, 1991 [JP] Japan ..... 3-330736

[51] Int. Cl.[5] ..... G03G 15/00

[52] U.S. Cl. ..... 355/320; 271/186; 355/318

[58] Field of Search ..... 355/23, 24, 320, 318, 355/319, 317; 271/3, 3.1, 7, 258, 264, 265, 186, 902

[56] References Cited

U.S. PATENT DOCUMENTS

| | | | |
|---|---|---|---|
| 4,158,500 | 6/1979 | DiFrancesco et al. | 355/23 X |
| 4,176,945 | 12/1979 | Holthauser et al. | 355/23 |
| 4,744,553 | 5/1988 | Hirose | 355/23 X |
| 5,027,162 | 6/1991 | Kida et al. | 355/320 |
| 5,119,145 | 6/1992 | Honjo et al. | 355/308 |
| 5,197,723 | 3/1993 | Yamada et al. | 271/3 |

FOREIGN PATENT DOCUMENTS

| | | | |
|---|---|---|---|
| 0157260 | 9/1982 | Japan . | |
| 0232636 | 10/1987 | Japan . | |
| 1-236136 | 9/1989 | Japan . | |
| 0310230 | 12/1990 | Japan . | |
| 0107175 | 5/1991 | Japan | 355/320 |

*Primary Examiner*—A. T. Grimley
*Assistant Examiner*—Robert Beatty
*Attorney, Agent, or Firm*—Frishauf, Holtz, Goodman & Woodward

[57] ABSTRACT

In an automatic document conveying device, when a two-sided copying mode is selected, a document with a two-sided image is fed by a sheet feeder from a first stacker. After reading of a first face of the document is completed and before reading of a second face of the document, which is reversed by a reversing device is completed, a succeeding document is conveyed to a waiting position located upstream of the reading position and is stopped. After reading of the second face of the preceding document is completed, the document is conveyed to a discharger provided downstream of the reading position for discharging the document to a second stacker, keeping downward the image side which has been exposed, and at the same time the succeeding document is conveyed to the reading position and is read. Before reading of a second face of the succeeding document is completed, a subsequent document is conveyed to the waiting position. This operation cycle is repeated until all documents stacked on the first stacker have been fed.

6 Claims, 8 Drawing Sheets

AUTOMATIC DOCUMENT CONVEYANCE DEVICE

BACKGROUND OF THE INVENTION

The present invention relates to improvements in an automatic document feeder used for a recording device or an image reading device of an electrophotographic copier.

An automatic document feeder is generally provided on a platen glass in an image exposure section of a copier. In an optical system movement type copier to which the automatic document feeder is provided, documents are conveyed as follows: documents are sent out from a document stack tray (stack section) by the automatic document feeder one by one; conveyed onto the platen glass by a conveyance belt; and after the documents have been exposed by an exposure lamp provided in the copier body, they are discharged onto a document discharge tray.

In a conventional automatic document feeder, the document feeding operation is carried out in the following manner: after a paper discharge sensor has detected that a document on the platen has been discharged, the following document is sent out from the stack section onto the platen glass, and stopped at a predetermined position. Therefore, it takes a long period of time to replace a document placed on the platen. Accordingly, a large amount of time is required for a copying operation, and the productivity is low.

In the case where an automatic document feeder is used, the copying productivity can be increased to 100% when a document is replaced within the time in which the optical scanning system is returned. In order to replace the document within the time in which the optical scanning system is returned, it is necessary to increase the document conveyance speed when the document is conveyed from a double feeding prevention device of the document stack section to a document stop position on the platen glass. However, in order to convey the document at high speed, the following various problems are caused, such as an increase in the motor dimensions, an increase in electrical power consumption, noises, abrasion of the conveyance belt, damage of the document, and deterioration of the document separation property.

A document conveyance device of the prior art is disclosed in Japanese Patent Application Open to Public Inspection No. 236136/1989 in which the aforementioned problems are solved and the document replacing time can be shortened without an increase in the document conveyance speed.

This document feeder is operated in the following manner: the first document is stopped at a predetermined position on the platen glass; the second document is stopped at a position adjacent to the predetermined position, wherein the position is not located on the platen glass; after the first document has been exposed, it is conveyed to a downstream position adjacent to the predetermined position, wherein the downstream position is located on the platen glass; at the same time, the second document is conveyed to the predetermined position and stopped; and the third document and documents after that are conveyed in the aforementioned manner.

However, it is difficult to apply the aforementioned document conveyance system to two-sided documents.

According to the prior art, a two-sided document is copied in the following manner: the two-sided document is conveyed on to the platen glass; the first side of the document is exposed; the document is reversed by an inversion conveyance means; the document is conveyed onto the platen glass and the second surface is exposed; after that, the document is reversed by the inversion conveyance means; and the document is discharged outside the apparatus in a collated condition. In the aforementioned automatic two-sided document feeder, the interval from the trailing edge of the first document to the leading edge of the second document is large, so that the document replacement time is disadvantageous.

SUMMARY OF THE INVENTION

It is a primary object of the present invention to solve the aforementioned problems caused in the two-sided document conveyance operation of the automatic document feeder of the prior art so as to improve the copying capacity.

That is, the object of the present invention is to increase the copy speed by reducing the document replacing time in the following manner: in the case where a successive document is conveyed to a predetermined position while a previous document is being exposed, and also in the case where the previous document is reversed while the successive document is being exposed, the interval from the trailing edge of the previous document to the leading edge of the successive document is made as small as possible to shorten the document replacement time.

In order to accomplish the aforementioned object, the present invention is to provide an automatic document feeder comprising:

- a document stack tray on which a document stack composed of one-sided or two-sided documents is placed;
- a document feed means that separates documents from the document stack and feeds them one by one;
- at least one pair of conveyance rollers that is disposed downstream of the document feed means and conveys the separated documents;
- a reading section that is disposed downstream of the conveyance rollers at which document information is read with an optical system;
- a conveyance means that can convey the document while the conveyance means is pressing the document against the reading section;
- an inversion means that is disposed close to the conveyance means and reverses the document so that a second surface opposite to a first surface, can be exposed to the reading section;
- a discharged paper stack section that stacks the documents discharged downstream from the reading section;
- a first paper discharge means that is disposed downstream of the conveyance means and discharges the documents onto the discharged paper stack section while the document surface displayed in the reading section is maintained downward; and
- a second paper discharge means that discharges the document onto the discharged paper stack section while the document surface displayed in the reading section is set upward. When the two-side document copy mode is selected in the automatic document feeder, operations are carried out as follows.

A two-sided document is sent out from the document stack tray. After the first surface of the first document has been read by the reading section, the first document is reversed by the inversion means. Before the second surface of the first document is read, the second document is conveyed to a waiting position located upstream of the reading section, and the second document waits for the successive operation. After the second surface of the first document has been read, the first document is conveyed to the paper discharge means, and the second document waiting for the successive operation is conveyed to the reading section. While the first surface of the second document is being read in the reading section, a document discharging operation is continued by the second paper discharging means, and before the second surface of the second document has been read, the third document is conveyed to the waiting position located upstream of the reading section and waits for the successive operation. The aforementioned operation is repeated until all the documents have been processed.

DETAILED DESCRIPTION OF THE PREFERRED EMBODIMENTS

With reference to the attached drawings, an example of the present invention will be explained in detail as follows.

Figure 1:
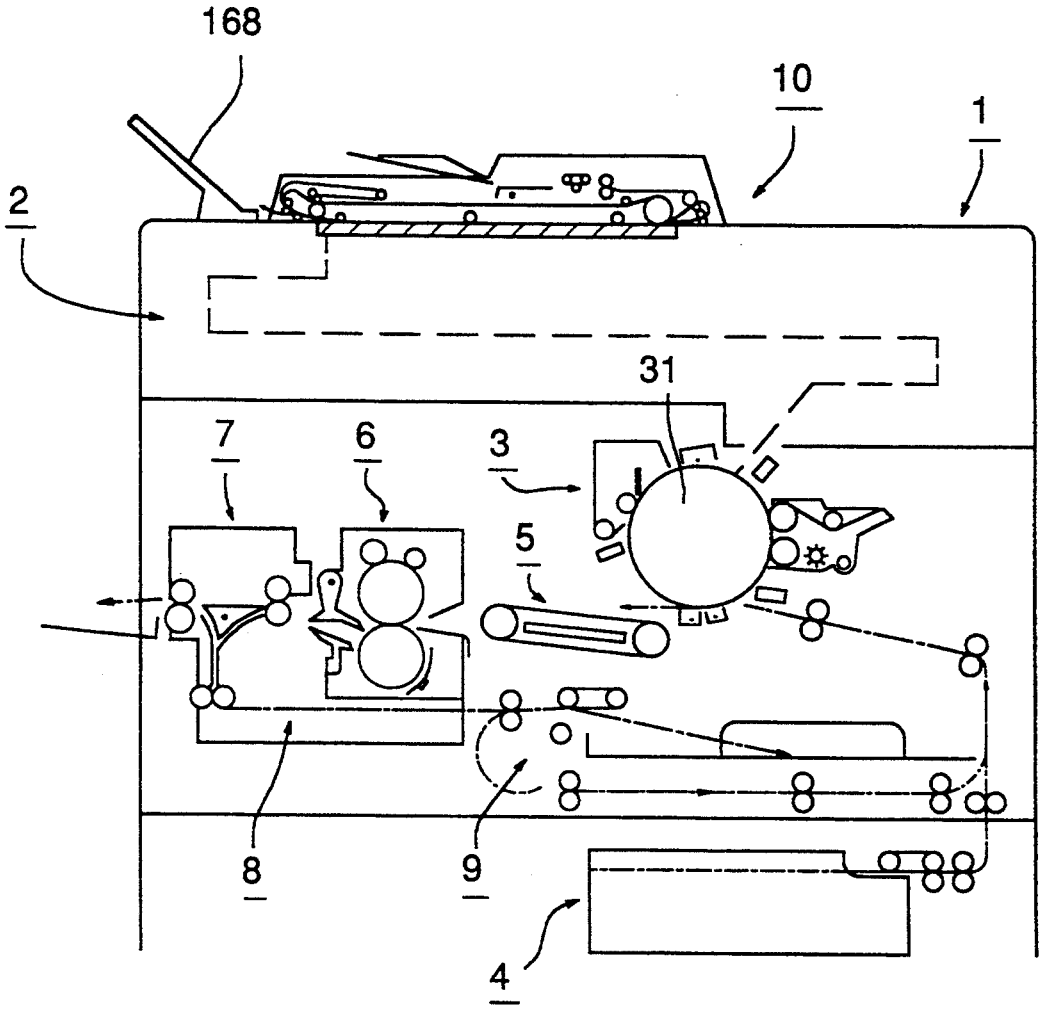
FIG. 1 is a schematic illustration showing the entire structure of an image recording apparatus to which the automatic document feeder of the present invention is provided.

FIG. 1 is a schematic illustration showing the entire structure of an image recording apparatus (copier) to which the automatic document feeder of the present invention is provided. In FIG. 1, numeral 1 is a copier body, numeral 2 is an optical scanning exposure system, numeral 3 is an image forming means disposed around a photoreceptor drum 31, numeral 4 is a copy paper supply means (paper supply means), numeral 5 is a copy paper conveyance means, numeral 6 is a fixing unit, numeral 7 is a discharged paper inversion changeover means, numeral 8 is an inversion conveyance means, numeral 9 is a two-sided recording paper conveyance means (ADU), and numeral 10 is an automatic document feeder (RADF) having a two-sided document automatic inversion function and a paper tray 168 for holding documents which are discharged from the apparatus.

Figure 2:
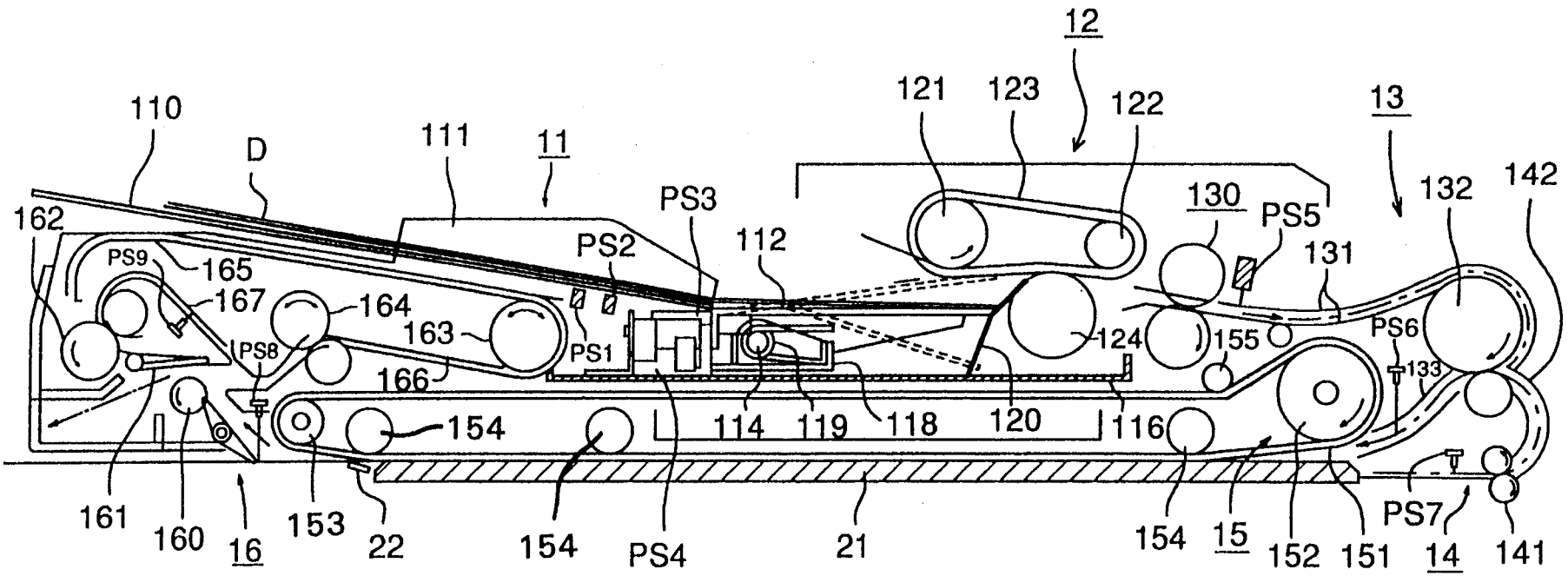
FIG. 2 is a sectional view of the automatic document feeder of the present invention.
Figure 3:
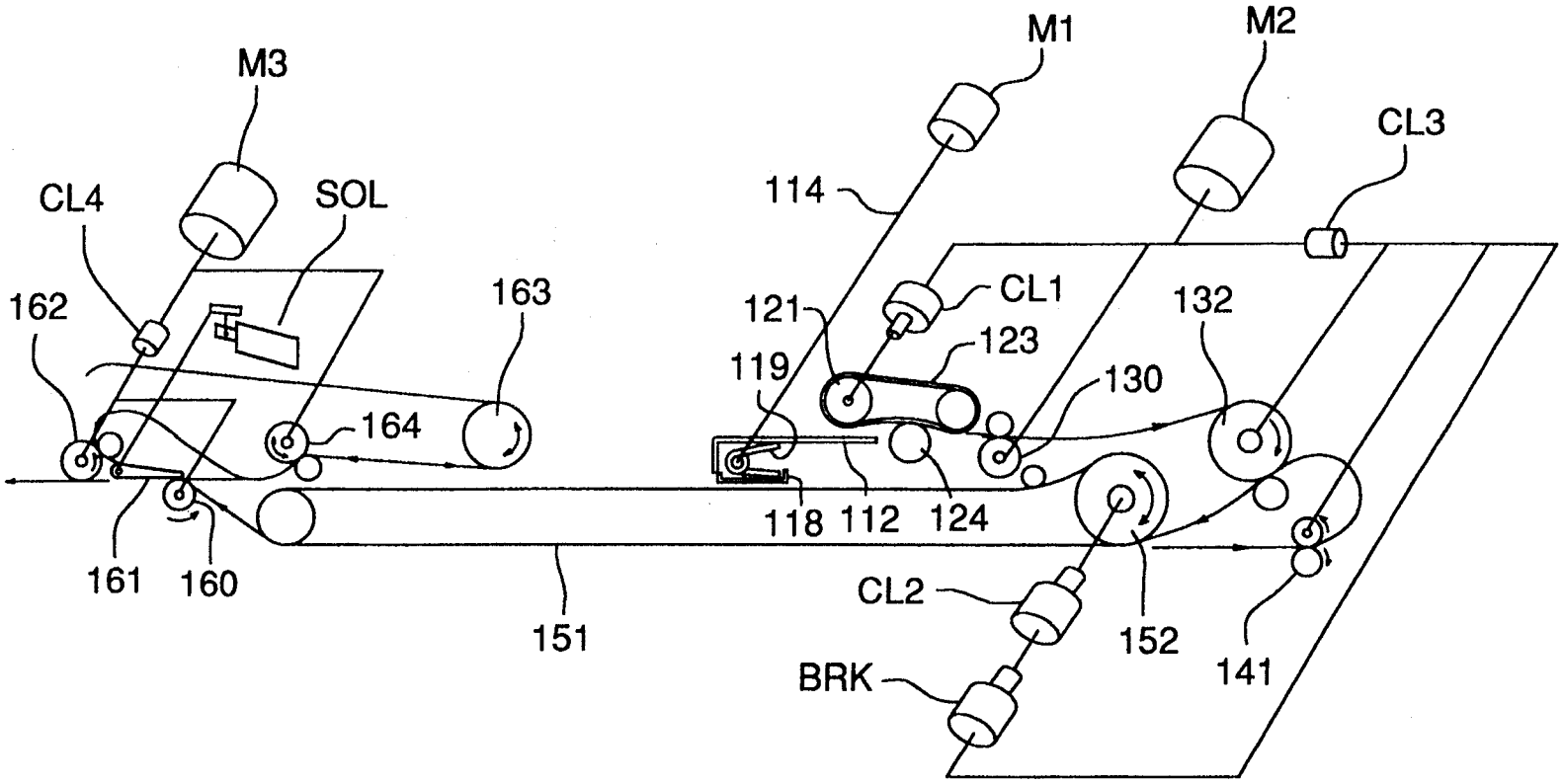
FIG. 3 is a schematic illustration showing the structure of the drive system (power transmission system) of the automatic document feeder.

FIG. 2 is a sectional view of the automatic document feeder 10 of the present invention, and FIG. 3 is a schematic illustration showing the structure of the drive system (power transmission system) of the automatic document feeder. As illustrated in FIG. 1, the automatic document feeder 10 is disposed on the copier body 1, and includes: a document stack section 11 on which a document stack is provided; a paper feed section 12 that separates a sheet of document D from the document stack; a conveyance section 13 that conveys document D sent from the paper feed section 12 to a predetermined section on a platen glass 21; and a paper discharge and inversion section 16 that discharges document D sent out from the conveyance section 13 after exposure, to a discharged paper tray or the following processing unit, and that reverses the document in the image exposure section to convey it onto the platen glass 21.

The document stack section 11 is provided with a stack tray 110 on which a document stack is loaded, and a width regulating plate 111 to regulate the width of documents is movably provided on the stack tray 110.

When document stack D is set on the stack tray 110, document set detection sensor PS1 detects the document stack, and the sign of ADF mode is displayed on a control panel of the copier body 1. When document stack D is set in a predetermined position, the document size (B5 to A3) is detected by document size sensor PS2 and inputted into the control section of the copier body 1.

Movable press plate 112 is disposed downstream of the stack tray 110 in the document flow direction. The movable press plate 112 is rotatably supported by an oscillating shaft 114.

Drive plate 118 is fixed to the oscillating shaft 114 by screws, so that the drive plate 118 can be oscillated integrally with the oscillating shaft 114. Resilient deformation member (for example, a torsion spring) 119 is wound around the oscillating shaft 114, and both end portions of the deformation member 119 come into pressure contact with the drive plate 118, and the center portion of the deformation member 119 comes into pressure contact with the movable press plate 112.

Actuator portions are provided to the drive plate 118. The actuator portion opens and closes an optical path of press detection sensor (for example, a photointerrupter) PS3 that is fixed to the movable press plate 112. The actuator portion opens and closes an optical path of home position detection sensor (for example, a photointerrupter) PS4 that is fixed to the fixed bottom plate 116, so that the home position of the drive plate 118 is detected.

The paper feeding section 12 is disposed downstream of document feed of the movable press plate 112. The paper feeding section 12 is composed of document leading edge stopper 120, drive roller 121, idle roller 122, feed belt 123 around both rollers, and reverse roller 124 located below to prevent double feeding. The drive roller 121 is driven by drive motor M2 through magnetic clutch CL1.

Conveyance section 13 is provided on the downstream side of document conveyance of the paper feeding section 12. The conveyance section 13 includes first intermediate conveyance roller 130, document detection sensor PS5, curved guide plate 131, and second intermediate conveyance roller 132. In this way, a conveyance passage is formed to convey document D from the paper feed section 12 onto the platen glass 21.

A discharge paper reversing section 14 is provided under the second intermediate conveyance rollers 132 in the right portion of the platen glass as shown in FIG.

2. The discharge paper reversing conveyance rollers 141 are provided with one-way clutch CL3, so that they are always rotated normally. Numeral 142 is a curved guide plate connecting the nip position of the second intermediate conveyance rollers 132 with that of the discharge paper reversing conveyance rollers 141. The curved guide plate 142 forms the document inversion paper conveyance passage. Inversion detection sensor PS7 is provided in the inversion paper conveyance passage, and detects the document when it passes through the detection sensor PS7.

The conveyance belt 151 is provided on the platen glass 21 in such a manner that the drive roller 152, idle roller 153, three document holding rollers 154 and tension roller 155 are rotatably wrapped by the conveyance belt 151. Clutch CL2 and brake BRK are mounted on the shaft of the drive roller 152, and the drive roller 152 is driven by drive motor M2.

The discharge paper reversing section 16 includes a discharge paper roller 160, changeover claw 161, a plurality of conveyance rollers 162, 163, 164, and guide plates 165, 166, 167. The discharge paper roller 160 and conveyance rollers 162 to 164 are driven by discharge paper motor M3. The discharge paper roller 160 and the conveyance roller 162 are normally rotated, and the conveyance rollers 163 and 164 are normally and reversely rotated. The changeover claw 161 is driven by solenoid SOL.

FIG. 4(A) to FIG. 4(M) are schematic illustrations explaining the progress of paper feeding, paper conveyance and paper discharging of a plurality of two-sided documents D. In the drawings, one-dotted chain line shows the conveyance passage of two-sided document D. FIG. 5 is a timing chart expressing the progress of document feeding and conveyance of the automatic document feeder (RADF).

Document feeding and conveyance operations are explained as follows.

(1) When the main switch of the copier body 1 is turned on under the condition shown in FIG. 3, motor M1 for pressing is driven, and the initial stop position of the movable press plate 112 is detected by home position detection sensor PS4, whereby motor M1 for pressing is stopped. That is, home position detection sensor (the second detection member) PS4 is turned on in the home position. In the case where the main switch is turned on and home position detection sensor PS4 is turned off, motor M1 is reversed, and when it is detected that home position detection sensor PS4 has been turned on, motor M1 for pressing is stopped, and the drive plate 118 and movable press plate 112 are stopped at the initial position. In the case where home position detection sensor PS4 is turned on, motor M1 for pressing is normally rotated for a moment so that home position detection sensor PS4 is turned off, and then motor M1 is reversed. After sensor PS4 has been turned on, motor M1 is stopped and the movable press plate 112 is set at the home position. This operation is effective for absorbing the time lag of drive gears and sensors. When the movable press plate 112 is set at the home position, clearance L is maintained in which the maximum amount of document stack D can be accommodated.

(2) When document stack D is placed on the stack tray 110 and the movable press plate 112, document set detection sensor PS1 is turned on and the device is set at the ADF mode. At the same time, document size sensor PS2 is turned on and the document size is detected.

(3) When the copy button is pressed, ADF operations can be started, so that copy operations can be started. Then, motor M1 (stepping motor) for pressing is rotated, so that the movable press plate 112 is oscillated through the drive member 118 secured to the oscillating shaft 114 and through the spring 119. The tip of the movable press plate 112 is raised so that stacked documents D are lifted. While the movable press plate 112 is being raised, the rotational angle of the oscillating shaft 114 is measured by a rotary encoder counting pulse count A.

(4) When the upper surface of documents D stacked on the movable press plate 112 comes into contact with the outer circumferential surface of the feed belt 123, the movable press plate 112 ceases holding the document stack. However, the drive plate 118 is further rotated counterclockwise compressing the torsion spring 119, so that distance m between the movable press plate 112 and the drive plate 118 is shortened.

(5) When distance m reaches a predetermined value, an actuator 118A provided on one end of the drive plate 118 turns on press detection sensor PS3 secured on the movable press plate 112, so that the pressure reaches an initial setting value (for example, 50 g) and the operation of pulse count A is stopped. Further, when the drive plate 118 is driven, the pressing force is increased, so that the movable pressing plate 112 presses document D against the feed belt 123 with a predetermined pressing force (for example, 100 g). After pressing, motor M1 for pressing is stopped.

In the manner described above, the document feeding preparation is completed, and successively the document feeding operation is started.

Feeding operations of two-sided documents will be explained as follows. A document stack composed of two documents of D1 and D2 will be explained here in order to simplify the explanation.

Figure 4:
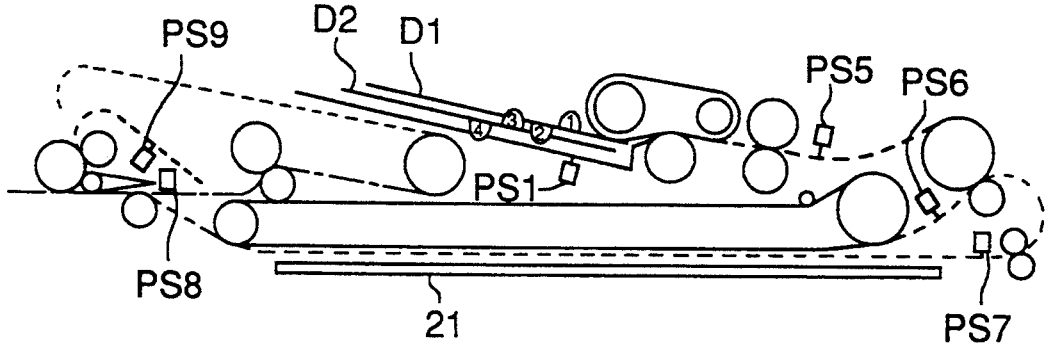
FIG. 4(A) to FIG. 4(M) are schematic illustrations explaining the process of operations when a plurality of two-sided documents are fed, conveyed and discharged.
Figure 4:
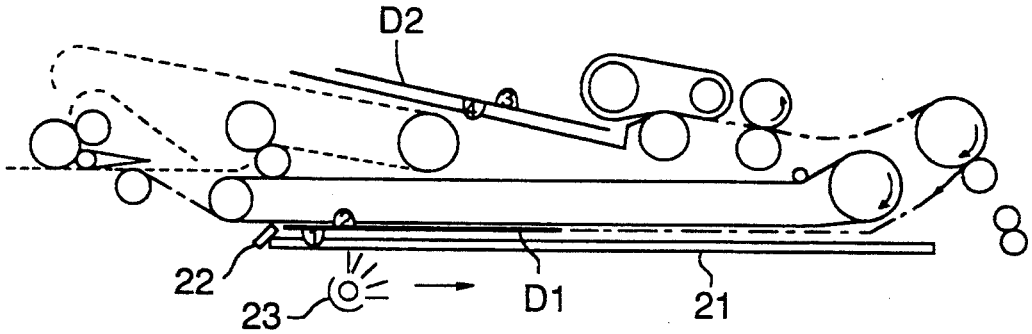
Figure 4:
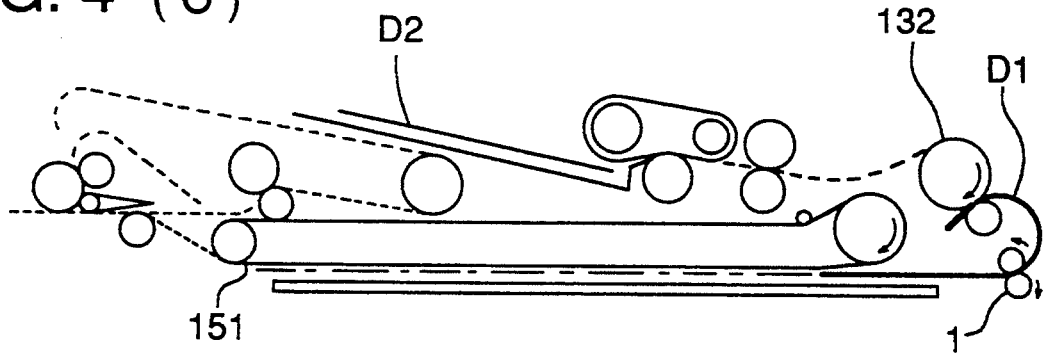
Figure 4:
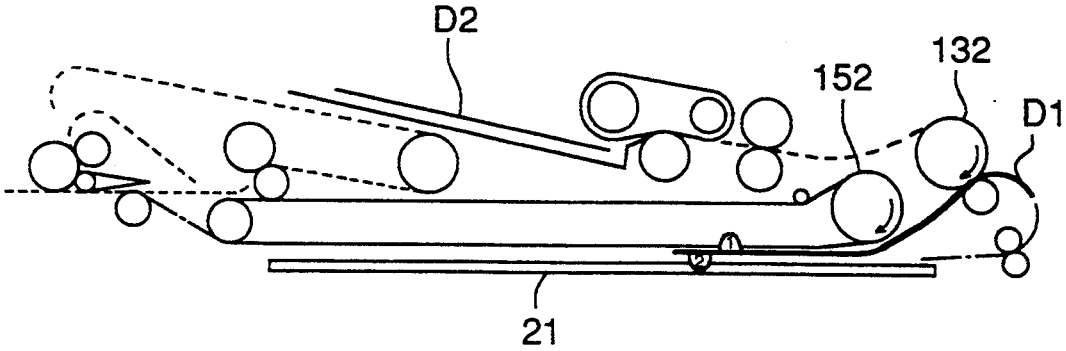
Figure 4:
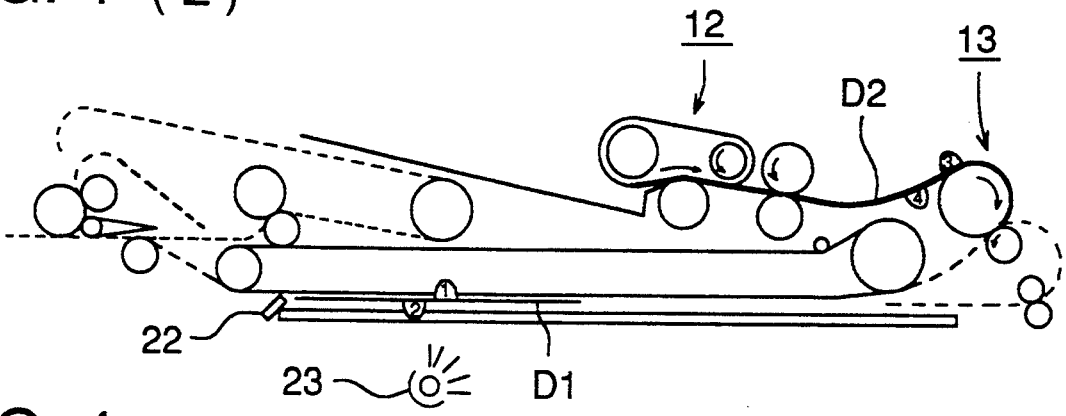
Figure 4:
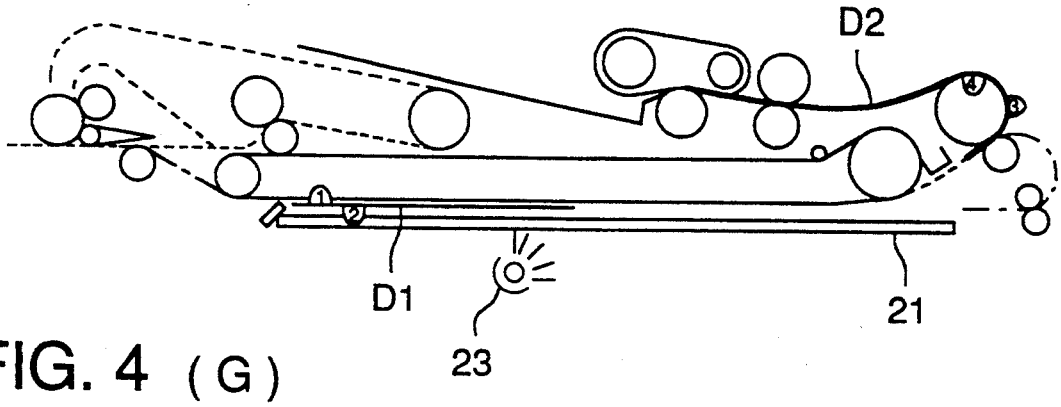
Figure 4:
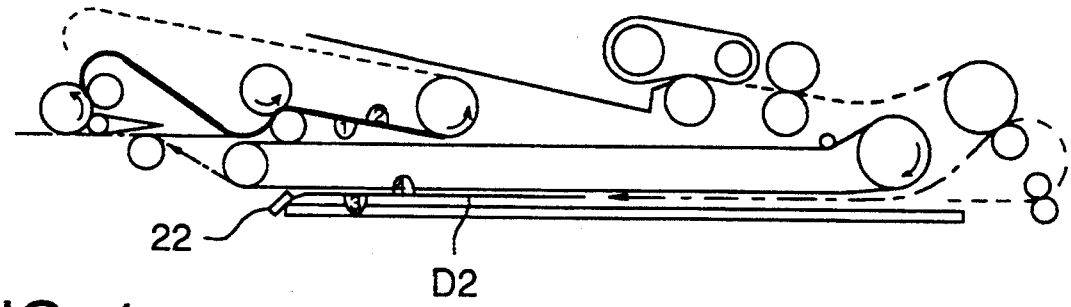
Figure 4:
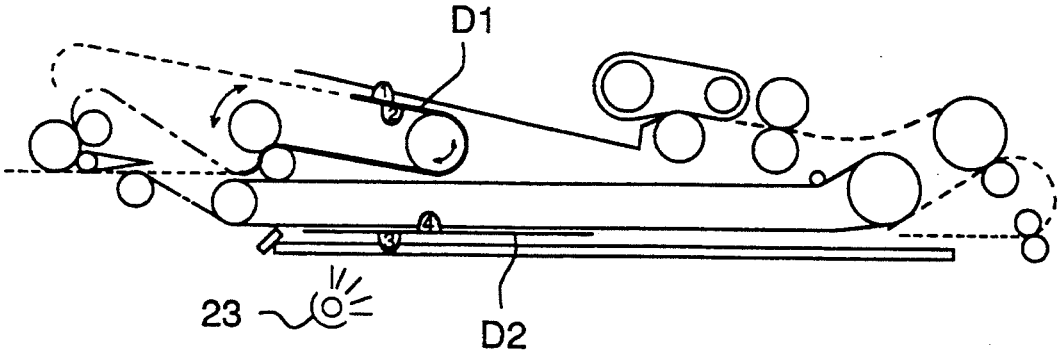
Figure 4:
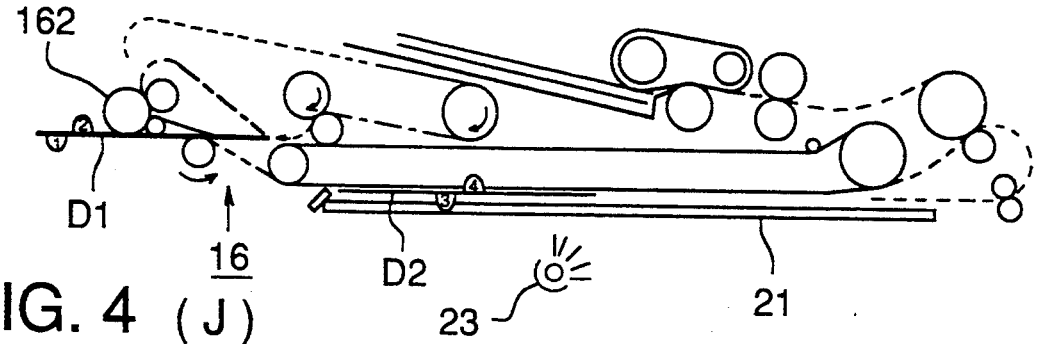
Figure 4:
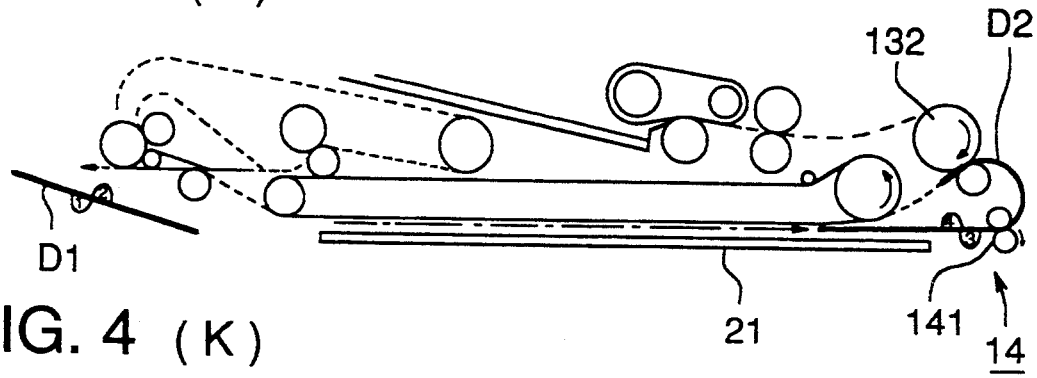
Figure 4:
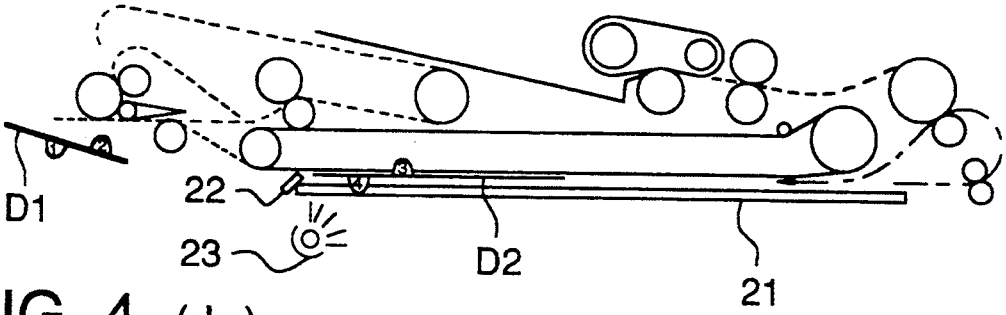
Figure 4:
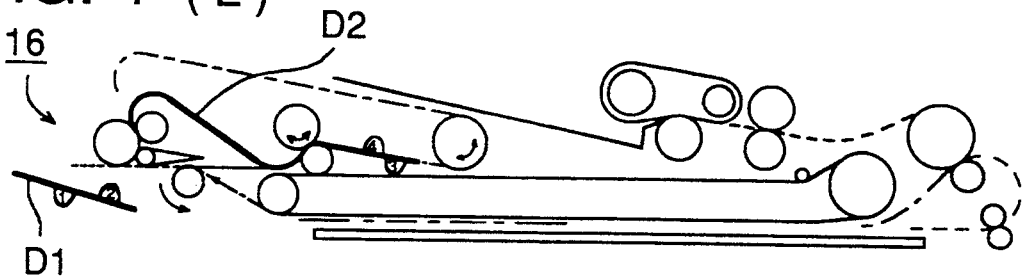
Figure 4:
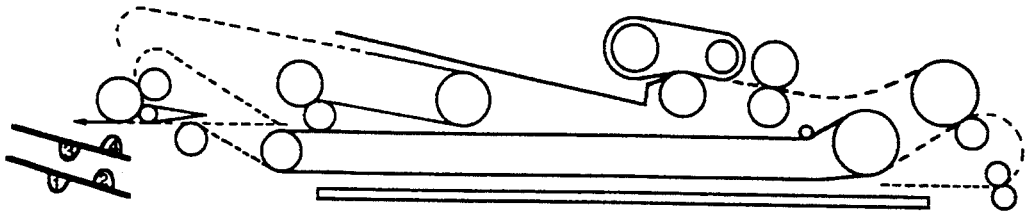
Figure 5:
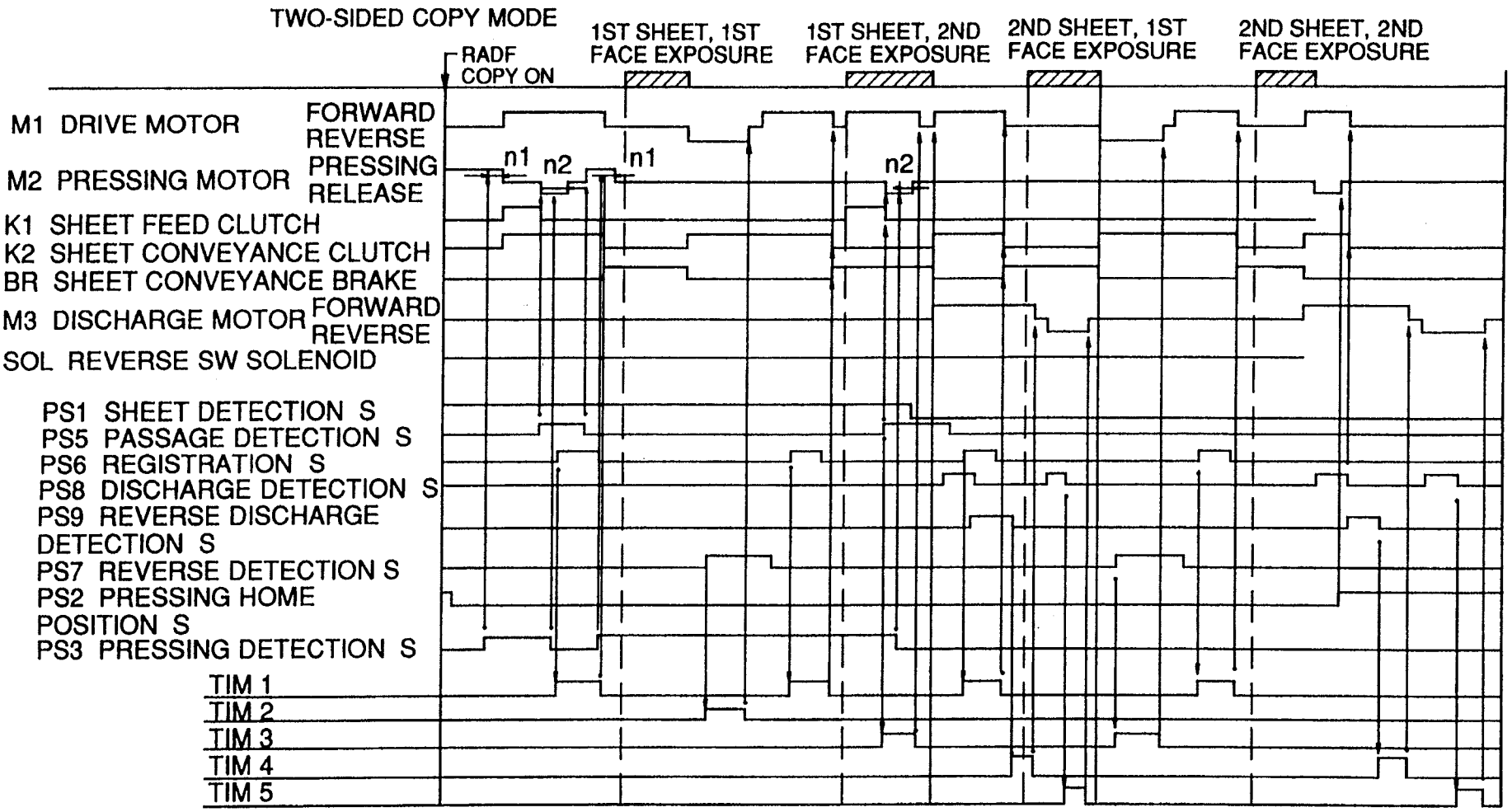
FIG. 5 is a time chart showing the conveyance process of a two-sided document.

FIG. 4(A) is a schematic illustration showing the document conveyance passage of the document feeder on which two-sided documents D1 and D2 are stacked. In the drawing, both the first surface (1) of the upper first document D1 and the first surface (3) of the lower second document D2 are set face-up on the stack tray 110 and the movable pressing plate 112. When the documents are stacked, the automatic document feeder 10 is started, and the device is set at the ADF mode. Further, the two-sided copy mode is set when the two-sided document button is pressed on the control panel of the copier body 1.

Referring to FIG. 4(B), when the copy button on the control panel is pressed, motor M1 for pressing is started, and the movable pressing plate 112 is raised, so that the uppermost surface of document stack D1 and D2 comes into contact with the feed belt 123. Approximately at the same time, drive motor (main motor) M2 is turned on, and concurrently electromagnetic clutches $CL_1$ and $CL_2$ are turned on, so that the document feeding operation is started.

Upper documents D are conveyed out by the feed belt 123 rotated by drive motor M2. Only the uppermost document D1 in the aforementioned several documents D is separated and fed by the reverse roller 124.

Document D1 separated in the aforementioned manner is nip-conveyed by the first intermediate conveyance rollers 130. When the leading edge of document D is detected by document sensor PS5, clutch CL1 that has driven the drive roller 121 is turned off. The feed belt 123 is idly rotated until the trailing edge of document D1 passes through sensor PS3, and after that the feed belt 123 is stopped.

When document sensor PS5 is turned on, motor M2 for pressing is switched to reverse rotation, so that the drive plate 118 and the movable pressing plate 112 are lowered, and the pressing motion is released.

When home position detection sensor PS4 detects that the drive plate 118 is returned to the initial position, motor M1 for pressing is stopped. In the case where a plurality of documents are successively fed, the drive plate 118 and the movable pressing plate 112 are not returned to the home position, but the lowering motions of the drive plate 118 and the movable pressing plate 112 are stopped halfway.

After the trailing edge of the first document D1 has passed and document sensor PS5 has been turned off, the pressing operation of the drive means is started in accordance with the detection signal, so that the drive plate 118 and the movable pressing plate 112 are raised to press the successive document.

The first document D1 is conveyed out by the paper separation and conveyance means, and conveyed by the first intermediate rollers 130. The leading edge of the document is detected by document sensor PS5. The document passes through the guide plate 131, and is conveyed by the second intermediate rollers 132 disposed downstream of the guide plate 131. Further, the document is conveyed through the guide plate 133 disposed downstream of the second intermediate rollers 132. When the leading edge of the document passes through registration sensor (document passing synchronizing sensor) PS6 disposed in the document passage, a detection signal is sent from the sensor so that the document conveyance operation can be controlled. That is, registration sensor PS6 controls the document stopper 22, motor M2 and paper feed clutch CL1 through a clock timer.

Next, in the conveyance means 15, the document is held and conveyed between the rotating conveyance belt 151 and the platen glass 21. The leading edge of document D1 collides with the document stopper 22 that is protruded from the left upper surface of the platen glass 21 by the action of a solenoid not shown in the drawing. When the leading edge of document D1 collides with the document stopper 22, the movement of the document is stopped.

When the document is stopped on the platen glass 21, the first surface (1) of document D1 is irradiated by the exposure lamp 23 of the optical scanning exposure system 2, so that the document image is formed on the photoreceptor drum 31 through the lens and mirrors.

Exposure operations, the number of which is the same as that of the copied sheets, are carried out. In this way, a series of copying processes are conducted with regard to the first side of document D1.

In FIG. 4(C), the operations are carried out as follows. After the copying operation of the first surface (1) of document D1 has been completed, drive motor M1 is reversely rotated, and therefore the conveyance belt 151 is reversely rotated. Document D1 on the platen glass 21 is nipped by the reversing conveyance rollers 141 that are rotated normally, and passes through the guide plate 142, and then the conveyance direction is reversed. Then, document D1 is held by the second intermediate rollers 132 that are normally rotated, and conveyed to the guide plate 133.

In FIG. 4(D), the operations are carried out as follows. When the trailing edge of document D1 is detected by the inversion detection sensor PS7, drive motor M1 is switched to normal rotation by the detection signal, so that the drive roller 152 is rotated normally and the conveyance belt 151 is rotated in the normal direction. Therefore, inverted document D1 is slid to the left on the platen glass 21.

In FIG. 4(E), the operations are carried out as follows. As explained above, reversed document D1 is slid on the platen glass 21, and comes into contact with the document stopper 22 and the conveyance belt 151 is stopped. Then, document D1 is stopped at a predetermined position, and successively the optical scanning exposure system including exposure lamp 23 is activated, so that the second surface (2) of the document D1 is scanned. Synchronously with the aforementioned scanning operation, paper feed clutch CL1 is turned on, and the feeding operation of the second document D2 is started, so that the document is conveyed from paper feed section 12 to the intermediate conveyance section 13.

In FIG. 4(F), the operations are carried out as follows. At the point of time when the irradiation of the second surface (2) of the first document D1 has been completed, the following second document D2 advances to a predetermined position of the guide plate 133 and waits for the next operation.

In FIG. 4(G), the operations are carried out as follows. After irradiation of the first document D1 has been completed, the conveyance belt 151 is normally rotated, so that document D1 is conveyed to the discharged paper inversion section 16. That is, when paper discharging motor M3 is rotated, the conveyance direction of document D1 is changed through the paper discharging roller 160, changeover claw 161 and conveyance roller 162. Then, document D1 is conveyed to the guide plate 167, conveyance roller 164, guide plate 166, and conveyance roller 163. At the same time, the second document D2 is also held by the rotating conveyance belt 151, and slidably conveyed on the platen glass 21. Then, document D2 comes into contact with the document stopper 22 so as to be positioned.

In FIG. 4(H), the operations are carried out as follows. Even while the first surface (3) of document D2 on the platen glass 21 is being irradiated, the previous document D1 is being conveyed in the conveyance passage in the discharged paper inversion section 16.

In FIG. 4(I), the operations are carried out as follows. While document D2 is being exposed, the previous document D1 is passed through the discharged paper inversion section 16. When the trailing edge of the document D1 is detected by inverted discharged paper sensor PS9, discharged paper motor M3 is reversed after a predetermined period of time has passed, and also the changeover claw 161 is changed over to the upside, so that the document is discharged outside the apparatus.

In FIG. 4(J), the operations are carried out as follows. After document D2 has been irradiated, it is conveyed in the reverse direction on the platen glass 21 by the reverse rotation of the conveyance belt 151, and held and conveyed by the inversion conveyance rollers 141 and the second intermediate conveyance rollers 132 of the inversion means 14.

In FIG. 4(H), the operations are carried out as follows. Document D2 that has passed through the conveyance passage in the inversion means 14, is conveyed to the right edge portion of the platen glass 21 under the condition that the document is reversed. The document is held by the conveyance belt 151 and slid on the platen glass 21. Then, the document is contacted with the document stopper 22 and stopped. After that, the second surface (4) of the stopped document D2 is irradiated in the same manner as described before.

In FIG. 4(L), the operations are carried out as follows. After the two sides have been exposed, document D2 is conveyed by the conveyance belt 151, and conveyed into the discharged paper inversion section 16. In the discharged paper inversion section 16, document D2 is reversed.

In FIG. 4(M), the operations are carried out as follows. After document D2 has been conveyed into the discharged paper inversion section 16 and then reversed, document D2 is discharged onto the discharged paper tray provided outside the apparatus, and stacked on the previous document D1.

As explained above, the automatic document feeder of the present invention is characterized as follows.

When the two-sided document copy mode is selected in the automatic document feeder, the operations are carried out as follows. A two-sided document is sent out from the document stack tray 110. After the first surface of the first document has been read by the reading section, the first document is reversed by the inversion means 14. Before the second surface of the first document is read, the second document is conveyed to a waiting position located upstream of the reading section, and the second document waits for the successive operation. After the second surface of the first document has been read, the first document is conveyed to the paper discharge inversion means 16, and the second document waiting for the successive operation is conveyed to the reading section. At least while the first surface of the second document is being read in the reading section, a document discharging operation is continued by the second paper discharging means, and before the second surface of the second document is read out, the third document is conveyed to the waiting position located upstream of the reading section and waits for the successive operation. The aforementioned operation is repeated until all the documents are processed.

The conveyance progress of a two-sided document is explained above. In the case of the one-sided document copy mode, when the first discharge is carried out, the document is conveyed from the second intermediate conveyance rollers 132 of the intermediate conveyance section 13 to the platen glass 21. Then, the document passes through the paper discharge roller 160 of the discharged paper inversion section 16 and the changeover claw 161, and is accommodated on the discharged paper tray 168 under the condition that the first surface is set downward.

As described above, in the automatic document feeder of the present invention, the paper feeding operation of the successive document and the paper discharging operation of the previous document are carried out while the present document is being exposed. Accordingly, the document conveyance time can be shortened, and copying productivity can be greatly improved.

In the apparatus of the present invention, documents are fed at low speed. Therefore, the document separation property can be improved, and document conveyance can be smoothly conducted, and further damage of the leading edge of the document can be prevented. Furthermore, document discharging operations are carried out by an independent drive source at low speed. Therefore, discharged documents can be stably aligned. Furthermore, the automatic document feeder can be simply and clearly controlled, and the production cost can be reduced. In the aforementioned explanation, the present invention is applied to a common automatic document feeder (RADF). However, it is clear that the present invention can be applied to a circulation type document conveyance device (RDH) and an automatic document feeder having a U-turn passage on the paper delivery side.

Figure 6:
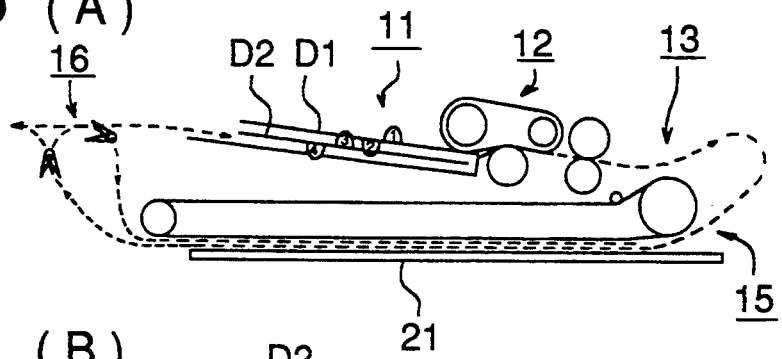
FIG. 6(A) to FIG. 6(F) are schematic illustrations showing the document conveyance process of another example of the present invention.
Figure 6:
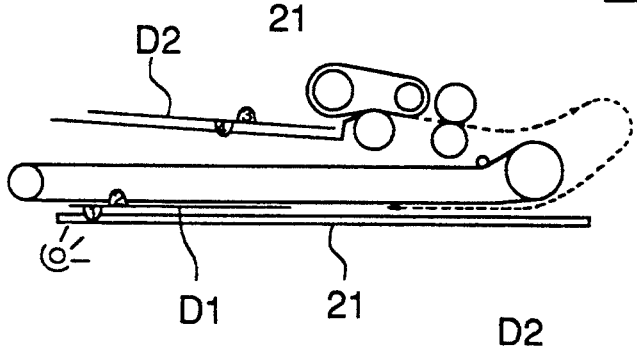
Figure 6:
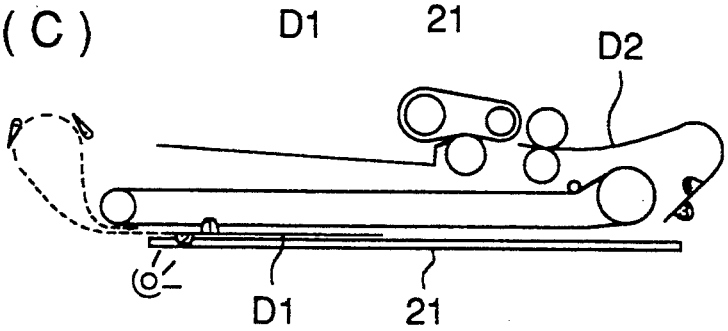
Figure 6:
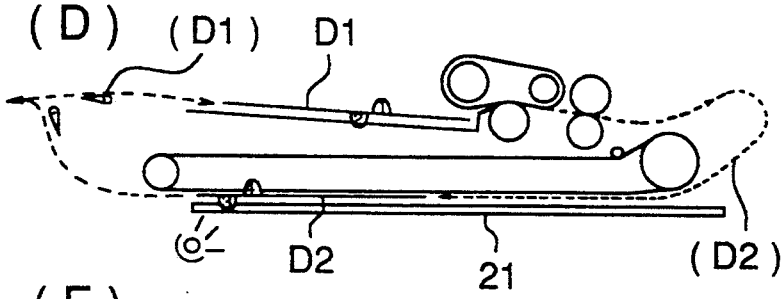
Figure 6:
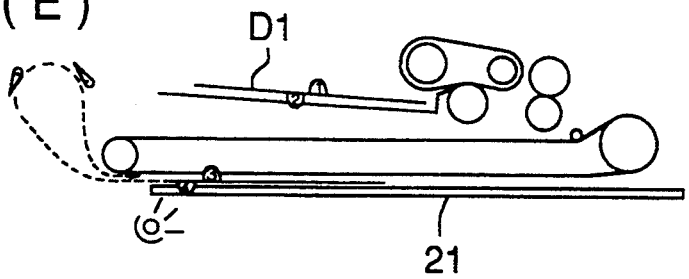
Figure 6:
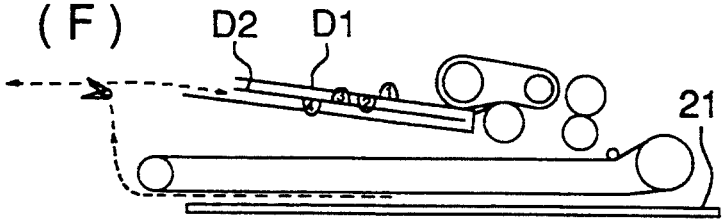

FIG. 6(A) to FIG. 6(F) are schematic illustrations showing the progress of document conveyance of a circulation type automatic document feeder (RDH) having a document inversion passage on the paper discharge side. FIG. 6(A) shows two-sided documents D1, D2 stacked on the document stack section 11, and a document conveyance passage (shown by a broken line).

The previous document D1 is conveyed to a predetermined position on the platen glass 21 by the conveyance means 15 through the paper feed section 12 and the intermediate conveyance section 13 . On the platen glass 21, the first surface (1) of the document is irradiated (shown in FIG. 6(B)) .

After irradiation, document D1 is reversed in the discharged paper inversion section 16, and conveyed again onto the platen glass 21 and stopped at a predetermined position so that the second surface (2) of the document is irradiated (shown in FIG. 6(C)). While document D1 is being reversed, conveyed and exposed, the successive document D2 is conveyed through the paper feed section 12 and the intermediate conveyance section 13, and temporarily stopped on the upstream side of the platen glass 21 to wait for the next operation.

After the second surface has been irradiated, document D1 is discharged onto the document stack section 11 through the conveyance passage shown by a broken line in FIG. 6(D), by the action of the conveyance means 15 and the discharged paper inversion section 16. At this time, the successive document D2 is concurrently conveyed onto the platen glass 21 by the intermediate conveyance section 13 and the conveyance means 15, and stopped at a predetermined position, and then the first surface (3) of document D2 is irradiated.

The successive document D2 is reversed in the discharged paper inversion section 16 in the same manner as described before. Then, the successive document D2 is conveyed again onto the platen glass 21 and stopped at a predetermined position. Then, the second surface (4) is irradiated (shown in FIG. 6(E)) .

Document D2, both sides of which have been already exposed, passes through the discharged paper inversion section 16, and is inserted under the previous document D1 on the document stack section 11 (shown in FIG. 6(F)) through guide means (not shown in the drawing).

What is claimed is:

1. An automatic document conveying device comprising:

(a) a first stacker on which a stack of documents is stacked, each document having a first and a second face, each document also having an image on said first face or on said first face and said second face thereof, said documents being stacked in a given order on said first stacker;

(b) a feeder for separating and feeding said documents, one by one, from said first stacker;

(c) at least a pair of conveyance rollers positioned in a downstream feeding direction, downstream of said feeder, for conveying a separated one of said documents;

(d) a reading position, provided in said downstream feeding direction, downstream of said pair of conveyance rollers, where image information on said separated one of said documents is read by a reader including an optical system;

(e) conveying means for conveying said separated one of said documents in said downstream feeding direction, while pressing said first face of said separated one of said documents toward said reader;

(f) a discharged paper inversion section for discharging a previously separated one of said documents that was separated from said stack of documents immediately prior to the separated one of said documents, from said automatic document conveying device after a reversal of said first and second faces of said previously separated one of said documents, said discharging of said previously separated one of said documents occurring while said first face of said separated one of said documents is being read by said reader;

(g) reversing means provided adjacent to said reading position and said conveying means, for reversing said first and second faces of said separated one of said documents, whereby said second face of said separated one of said documents is readable at said reading position by said reader;

(h) a second stacker on which each separated one of said documents is stacked, said second stacker being positioned in said downstream feeding direction, downstream of said reading position;

(i) said discharged paper inversion section being provided in said downstream feeding direction, downstream of said reading position and said conveying means, said discharged paper inversion section discharging documents in said given order to said second stacker; and (j) control means, for controlling a movement of each document of said stack of documents on said first stacker of said automatic document conveying device such that when a two-sided copying mode is selected:

said control means controls a first movement of a first document having an image on each of said first and second faces thereof, so that said first document is fed from said first stacker and is conveyed by said conveyance rollers and said conveying means to said reading position at a location downstream of said reversing means, without being reversed by said reversing means, so that said first face of said first document is readable at said reading position by said reader while said previously separated one of said documents is being discharged after a reversal thereof by said discharged paper inversion section; and before a reading of said second face of said first document by said reader occurs, said first and second faces of said first document are reversed by said reversing means, whereby said second face of said first document is readable at said reading position by said reader, while said control means concurrently controls a first movement of a succeeding document so that said succeeding document is moved to and stopped at a waiting position located in an upstream direction, upstream of said reading position, before a reading of said second face of said first document by said reader at said reading position is completed; and then after said second face of said first document is read at said reading position by said reader, said control means controls a second movement of said first document so that said first document is conveyed to and discharged by said discharged paper inversion section, at least while said first face of said succeeding document is being read at said reading position by said reader; and before a reading of said second face of said succeeding document is completed, said control means controls a first movement of a further succeeding document so that said further succeeding document is moved to and stopped at said waiting position; and wherein:

said control means controls a movement of each of a remaining plurality of documents, stacked on said first stacker, through said automatic document conveying device until all image information on said remaining plurality of documents, stacked on said first stacker, is read at said reading position by said reader and all of said remaining plurality of documents are discharged by said discharging means.

2. The device of claim 1, wherein said first and second stackers comprise a single common stacker so that an original document stacked on said second stacker is re-fed by said feeder to said conveying means for a reading of a second face of said original document by said reader.

3. The device of claim 1, further comprising another discharging means provided in said downstream feeding direction, downstream of both said reading position and said conveying means, for discharging documents to said second stacker in an order opposite to said given order.

4. The device of claim 1, further comprising:

a further discharging means provided in said downstream feeding direction, downstream of said reading position and said conveying means, for discharging a document so that a given image side thereof faces in a direction opposite to a direction that said given image side of said document faces when said document is discharged from the first mentioned discharging means.

5. A method for two-sided copying of a plurality of documents stacked in a given order on a first stacker of an automatic document conveying device, each of said documents having a first and a second face and an image either on said first face thereof or on said first and second faces thereof, the method comprising:

(a) separating and individually conveying each of said documents stacked on said first stacker toward a reading position where image information on each of said separated documents is read by a reader;

(b) stopping a movement of each of said documents, except a first document, at a waiting position that is adjacent to said reading position;

(c) reading said first face of a first document at said reading position with said reader;

(d) discharging a previously separated one of said documents, that was separated from said stack of documents immediately prior to said first document being separated from said stack of documents, from a discharged paper inversion section of said automatic document conveying device, said discharged paper inversion section reversing said first add second faces of said previously separated one of said documents prior to said discharging of said previously separated one of said documents from said discharged paper inversion section, said discharging of said previously separated one of said documents occurring while a first face of said first document is being read by said reader;

(e) then, reversing said first and second faces of said first document whereby said second face of said first document is readable at said reading position by said reader, while simultaneously moving a second document to, and stopping said second document at, a waiting position;

(f) then, reading said second face of said first document at said reading position with said reader;

(g) then, discharging said first document from said discharged paper inversion section while simultaneously moving said second document from said waiting position to said reading position and reading said first face of said second document with said reader while said first document is being discharged by said discharged paper inversion section;

(h) then, reversing said first and second faces of said second document whereby said second face of said second document is readable at said reading position by said reader, while simultaneously moving a third document to, and stopping said third document at, said waiting position; and (i) then, repeating steps (d) through (h) until all documents on said first stacker are discharged from said automatic document conveying device in said given order.

6. The method of claim 5, further comprising stacking each of said documents on a second stacker after said first face of each document is read by said reader.

* * * * *